US008985939B2

(12) United States Patent
Yin

(10) Patent No.: US 8,985,939 B2
(45) Date of Patent: Mar. 24, 2015

(54) SERIAL FAN FRAME ASSEMBLY STRUCTURE

(75) Inventor: Guan-Chen Yin, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 384 days.

(21) Appl. No.: 13/473,613

(22) Filed: May 17, 2012

(65) Prior Publication Data

US 2013/0309083 A1 Nov. 21, 2013

(51) Int. Cl.
*F04D 19/02* (2006.01)
*F04D 29/64* (2006.01)
*F04D 19/00* (2006.01)

(52) U.S. Cl.
CPC ..... *F04D 19/007* (2013.01); *F04D 29/646* (2013.01)
USPC ..... 415/68; 415/214.1; 415/220

(58) Field of Classification Search
CPC ... F04D 19/007; F04D 29/522; F04D 29/644; F04D 29/646
USPC ..... 415/60, 66, 68, 220, 223, 213.1, 214.1
See application file for complete search history.

(56) References Cited

U.S. PATENT DOCUMENTS

2010/0020493 A1* 1/2010 Lee et al. ..... 361/695
2010/0329860 A1* 12/2010 Li ..... 415/213.1
2013/0189076 A1* 7/2013 Liu et al. ..... 415/68

* cited by examiner

*Primary Examiner* — Christopher Verdier

(57) ABSTRACT

A serial fan frame assembly structure includes a first fan frame and a second fan frame. The first fan frame has a first and a second retainer, as well as a first and a second receiving slot; and the second fan frame has a first and a second receiving recess, as well as a first and a second post. The first and second retainer are configured for correspondingly engaging with the first and second recesses, while the first and second posts are configured for correspondingly engaging with the first and second receiving slots, so that the first and the second fan frame can be quickly assembled together in a manner capable of reducing vibration during the operation of a serial fan.

6 Claims, 3 Drawing Sheets

SERIAL FAN FRAME ASSEMBLY STRUCTURE

FIELD OF THE INVENTION

The present invention relates to a serial fan frame assembly structure, and more particularly to a serial fan frame assembly structure having first and second fan frames that can be quickly assembled together in a manner capable of preventing vibration during the operation of a serial fan.

BACKGROUND OF THE INVENTION

People's reliance on various electronic devices increases with the progress in the technological field. These electronic devices, such as computers and notebook computers, have internal elements that produce a large amount of heat during the operation of the electronic devices. The produced heat must be timely removed from the electronic devices to avoid the problem of overheated electronic devices. A cooling fan is usually provided in an electronic device for producing air flows and accordingly maintaining the electronic device at a specific operating temperature. However, there are times one single cooling fan is not sufficient to provide the required air flows. Therefore, two or more fans are frequently serially assembled together to provide sufficient air flows.

Taiwan Patent Publication No. 481434 discloses a Cooling Device for Central Processing Unit, which includes radiating fins and at least two fans and is characterized in that the at least two fans are serially connected end to end but spaced from each other by a plurality of connecting posts therebetween. The serial fan formed from two serially connected fans provides enhanced air flows and air pressure to more efficiently remove the high amount of heat produced by the central processing unit and absorbed by the radiating fins, and can therefore achieve an upgraded and quick cooling effect.

The cooling device for central processing unit disclosed in Taiwan Patent Publication No. 481434 also includes through holes provided at four corners of the fan frames of the two fans, so that screws can be threaded into the through holes to serially connect the two fans to one another and lock them to the radiating fins.

The problem in implementing the serial connection of two fans simply with screws lies in that the force used to tighten the screws is applied at points on one side of one fan instead of being applied on the contact surface of the two fans, which results in insufficient serial connection strength as well as noise produced during the operation of the serial fan. Meanwhile, air flows tend to leak via the space left between the two serially connected fans to adversely reduce the volume of air flows that can be acted on the radiating fins and accordingly reduce the heat dissipation performance of the serial fan.

According to another way of assembling a serial fan, one of the two fans to be serially connected together is provided at four corners with a plurality of through holes while the other fan is provided with at least one projection at positions corresponding to the through holes. By inserting the projections into the through holes, the two fans can be serially connected together and held in place. While this way enables two fans to fixedly connect to one another, the connection tightness between the two fans is poor to cause vibration and noise during the operation of the serial fan.

In brief, the prior art serial fans have the following shortcomings: (1) having poor connection tightness between the two serially connected fans; (2) producing vibration and noise during operation; and (3) using an inconvenient assembling manner.

SUMMARY OF THE INVENTION

It is therefore a primary object of the present invention to overcome the shortcomings in the prior art serial fans by providing a serial fan frame assembly structure that enables quick alignment and assembling of fan frames of a serial fan.

To achieve the above and other objects, the serial fan frame assembly structure according to the present invention includes a first fan frame and a second fan frame.

The first fan frame has a first open end and an opposite second open end, as well as a first flow path. The first and second open ends communicate with the first flow path. The second open end is provided at two pairs of corners with a first and a second retainer, as well as a first and a second receiving slot.

The second fan frame has a third open end and an opposite fourth open end, as well as a second flow path. The third and fourth open ends communicate with the second flow path. The fourth open end is provided at two pairs of corners with a first and a second receiving recess, as well as a first and a second post. The first and second posts are sidewardly extended away from the fourth open end. The first and second retainer are configured for correspondingly engaging with the first and second recesses, while the first and second posts are configured for correspondingly engaging with the first and second receiving slots.

With the serial fan frame assembly structure of the present invention, a serial fan can be assembled without the need of using fastening elements to lock the fan frames to one another, and the fan frames can be quickly aligned with and assembled to one another with an enhanced connection tightness between them to avoid vibration and noise during the operation of the serial fan.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
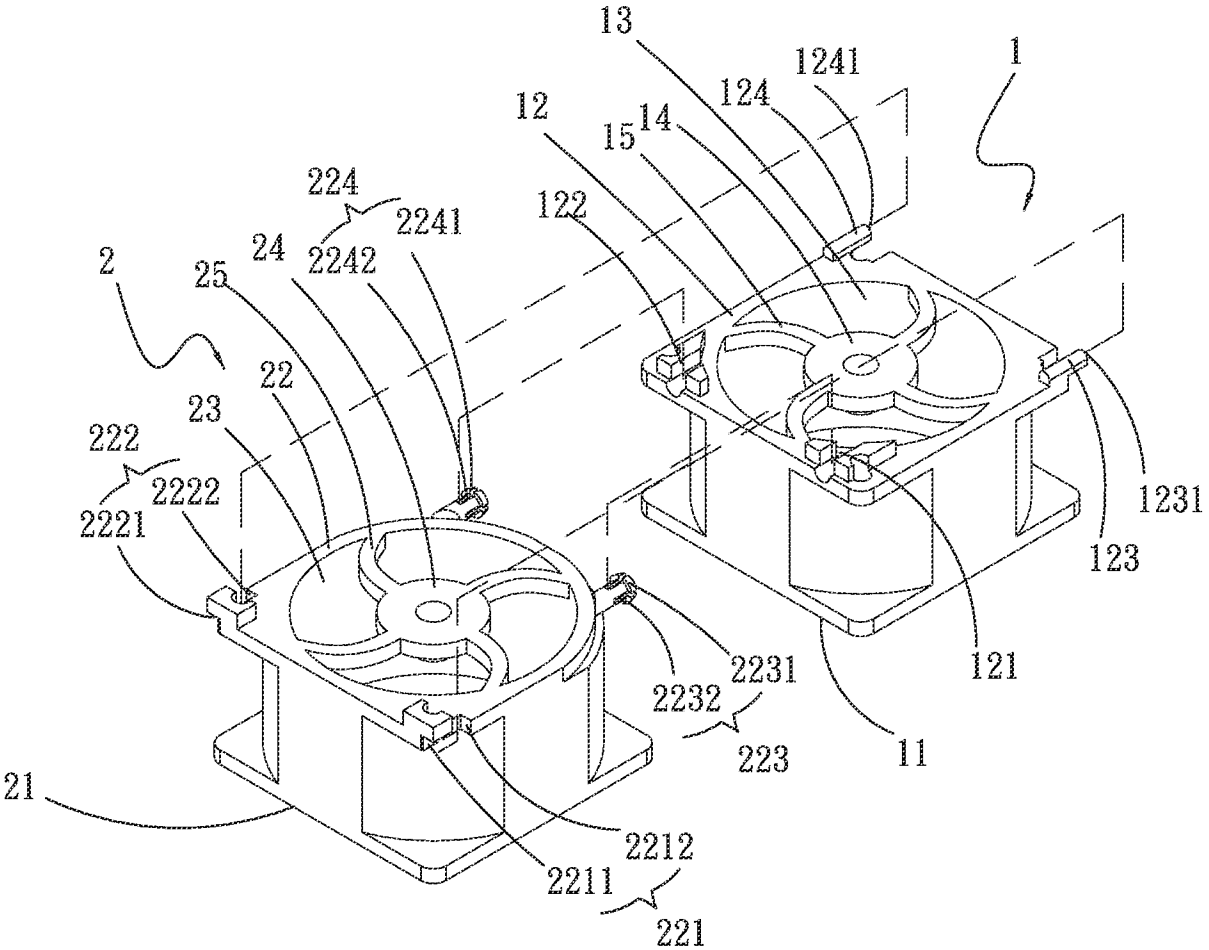
FIG. 1 is an exploded perspective view of a serial fan frame assembly structure according to a first embodiment of the present invention.

The present invention will now be described with some preferred embodiments thereof and with reference to the accompanying drawings. For the purpose of being easy to understand, elements that are the same in the preferred embodiments are denoted by the same reference numerals.

Figure 2:
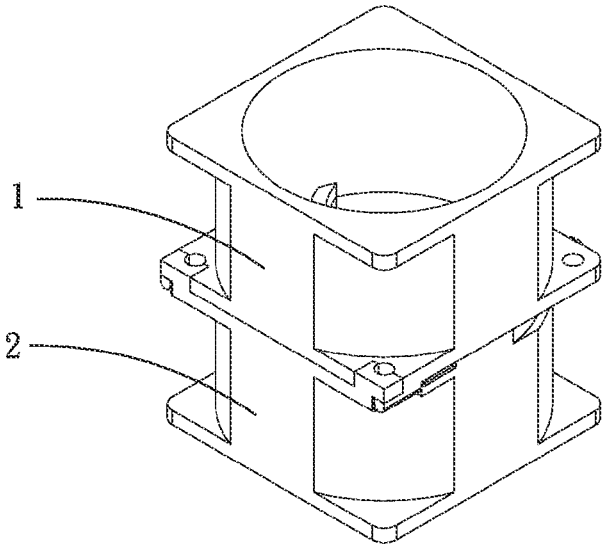
FIG. 2 is an assembled view of FIG. 1.

Please refer to FIGS. 1 and 2 that are exploded and assembled perspective views, respectively, of a serial fan frame assembly structure according to a first embodiment of the present invention. As shown, the serial fan frame assembly structure in the first embodiment includes a first fan frame 1 and a second fan frame 2.

The first fan frame 1 has a first open end 11 and an opposite second open end 12, as well as a first flow path 13. The first and second open ends 11, 12 communicate with the first flow path 13. The second open end 12 is provided at two pairs of corners with a first receiving slot 121 and a second receiving slot 122, as well as a first retainer 123 and a second retainer 124.

The second fan frame 2 has a third open end 21 and an opposite fourth open end 22, as well as a second flow path 23. The third and fourth open ends 21, 22 communicate with the second flow path 23. The fourth open end 22 is provided at two pairs of corners with a first receiving recess 221 and a second receiving recess 222, as well as a first post 223 and a second post 224. The first and second posts 223, 224 are sidewardly extended away from the fourth open end 22. The first and second retainers 123, 124 are configured for correspondingly engaging with the first and second recesses 221, 222, while the first and second posts 223, 224 are configured for correspondingly engaging with the first and second receiving slots 121, 122.

The first receiving recess 221 has a first open side 2211 and a first closed side 2212; and the second receiving recess 222 has a second open side 2221 and a second closed side 2222. The first retainer 123 has a first retaining end 1231 and the second retainer 124 has a second retaining end 1241. And, the first and second retaining ends 1231, 1241 are fitted in the first and second open sides 2211, 2221.

The first post 223 has a first expanded head portion 2231 and a first slit portion 2232 axially inward extended from the first expanded head portion 2231 by a predetermined length. Similarly, the second post 224 has a second expanded head portion 2241 and a second slit portion 2242 axially inward extended from the second expanded head portion 2241.

The second open end 12 has a first bearing cup seat 14 and a plurality of connection ribs 15 connected at two opposite ends to between the second open end 12 and the first bearing cup seat 14. The fourth open end 22 has a second bearing cup seat 24 and a plurality of connection ribs 25 connected at two opposite ends to between the fourth open end 22 and the second bearing cup seat 24. The first bearing cup seat 14 and the second bearing cup seat 24 are aligned with and connected to each other face to face, so that the first and the second flow path 13, 23 are communicable with each other.

To assemble the first fan frame 1 to the second fan frame 2, the first retainer 123 and the second retainer 124 of the first fan frame 1 are firstly respectively inserted into the first receiving recess 221 and the second receiving recess 222 of the second fan frame 2; and then the first post 223 and the second post 224, which are respectively located opposite to the first receiving recess 221 and the second receiving recess 222, are brought to engage with the first receiving slot 121 and the second receiving slot 122, respectively.

Figure 3:
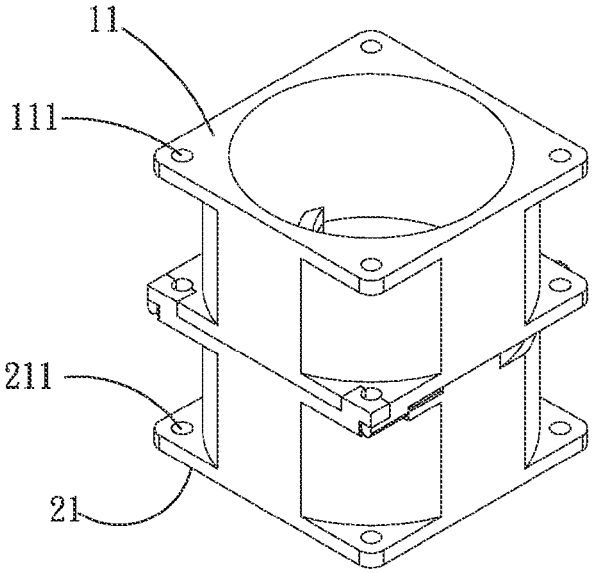
FIG. 3 is an assembled perspective view of a serial fan frame assembly structure according to a second embodiment of the present invention.

Please refer to FIG. 3 that is an assembled perspective view of a serial fan frame assembly structure according to a second embodiment of the present invention. As shown, the serial fan frame assembly structure in the second embodiment is generally structurally similar to that in the first embodiment, except for at least one hole 111 provided at each of four corners of the first open end 11 and at least one hole 211 provided at each of four corners of the third open end 21.

Figure 4:
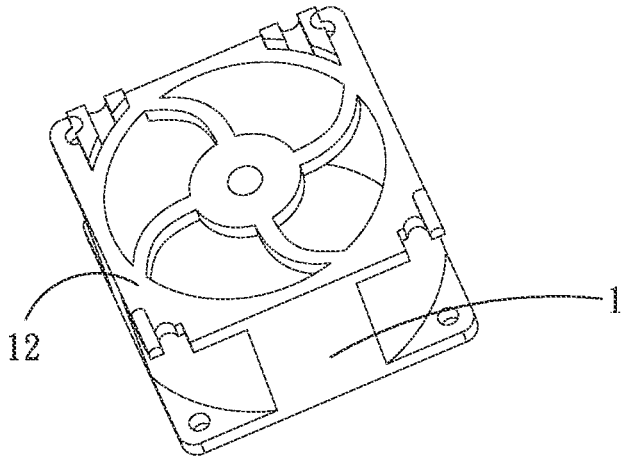
FIG. 4 is a perspective view of a first fan frame for a serial fan frame assembly structure according to a third embodiment of the present invention.
Figure 5:
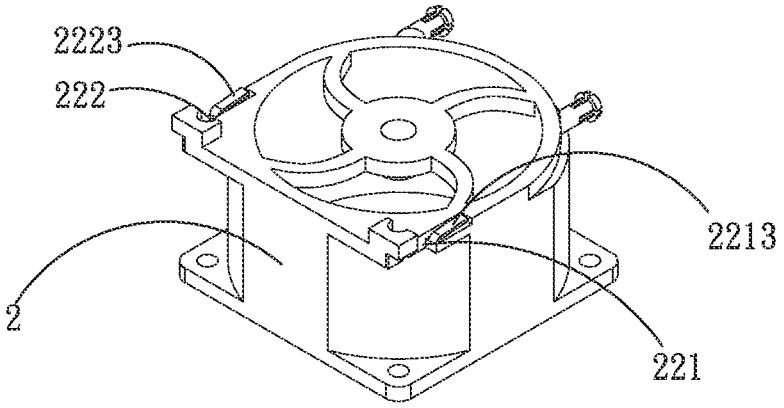
FIG. 5 is a perspective view of a second fan frame for the serial fan frame assembly structure according to the third embodiment of the present invention.

FIGS. 4 and 5 are perspective views of first fan frame 1 and second fan frame 2, respectively, for a serial fan frame assembly structure according to a third embodiment of the present invention. As shown, the serial fan frame assembly structure in the third embodiment is generally structurally similar to that in the first embodiment, except for a first packing member 2213 provided on a predetermined position adjacent to the first receiving recess 221 and a second packing member 2223 provided on a predetermined position adjacent to the second receiving recess 222. With the first and second packing members 2213, 2223, further increased connection tightness between the first and the second fan frame 1, 2 can be obtained when they are assembled to each other in the aforesaid manner The present invention has been described with some preferred embodiments thereof and it is understood that many changes and modifications in the described embodiments can be carried out without departing from the scope and the spirit of the invention that is intended to be limited only by the appended claims.

What is claimed is:

1. A serial fan frame assembly structure, comprising:

a first fan frame having a first open end and an opposite second open end, as well as a first flow path; the first and second open ends being communicable with the first flow path; and the second open end being provided at two pairs of corners with a first retainer and a second retainer, as well as a first receiving slot and a second receiving slot; and a second fan frame having a third open end and an opposite fourth open end, as well as a second flow path; the third and fourth open ends being communicable with the second flow path;

and the fourth open end being provided at two pairs of corners with a first receiving recess and a second receiving recess, as well as a first post and a second post; a first packing member provided at a predetermined position near but separate from the first receiving recess; a second packing member provided at a predetermined position near but separate from the second receiving recess the first and second posts being sidewardly extended away from the fourth open end; and the first and second retainers being configured for correspondingly engaging with the first and second recesses, while the first and second posts being configured for correspondingly engaging with the first and second receiving slots;

wherein the first and the second packing members are pressed against the second open end of the first frame when the first fan frame is assembled to the second fan frame.

2. The serial fan frame assembly structure as claimed in claim 1, wherein the first open end is provided at each of four corners with at least one hole, and the third open end is correspondingly provided at each of four corners with at least one hole.

3. The serial fan frame assembly structure as claimed in claim 1, wherein the second open end has a first bearing cup seat and a plurality of connection ribs connected at respective two opposite ends to between the second open end and the first bearing cup seat, and the fourth open end has a second bearing cup seat and a plurality of connection ribs connected at respective two opposite ends to between the fourth open end and the second bearing cup seat; and the first bearing cup seat and the second bearing cup seat being aligned with and connected to each other face to face.

4. The serial fan frame assembly structure as claimed in claim 1, wherein the first receiving recess has a first open side and a first closed side, and the second receiving recess has a second open side and a second closed side; and wherein the first retainer has a first retaining end and the second retainer has a second retaining end; and the first and second retaining ends being fitted in the first and second open sides of the first and second receiving recesses, respectively.

5. The serial fan frame assembly structure as claimed in claim 1, wherein the first post has a first expanded head portion and a first slit portion axially inward extended from the first expanded head portion by a predetermined length, and wherein the second post has a second expanded head portion and a second slit portion axially inward extended from the second expanded head portion.

6. The serial fan frame assembly structure as claimed in claim 1, wherein the first flow path and the second flow path are communicable with each other.

* * * * *